US010692629B2

(12) United States Patent
Lee et al.

(10) Patent No.: US 10,692,629 B2
(45) Date of Patent: Jun. 23, 2020

(54) FIRE RESISTANT CABLE

(71) Applicant: NEXANS, Courbevoie (FR)

(72) Inventors: Ho-Kyon Lee, Chungcheongbuk-do (KR); Young-Su Ro, Chungcheongbuk-do (KR); Sang-Hwan Kim, Chungcheongbuk-do (KR); Soung-Eun Park, Seoul (KR); Se-Kwang Oh, Chungcheongbuk-do (KR); Woo-Jin Park, Chungcheongbuk-do (KR); Jun-Young Park, Chungcheongbuk-do (KR); Dae-Won Kim, Chungcheongbuk-do (KR); Doo Yong Park, Chungcheongbuk-do (KR)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/035,046

(22) Filed: Jul. 13, 2018

(65) Prior Publication Data

US 2019/0131034 A1 May 2, 2019

(30) Foreign Application Priority Data

Jul. 13, 2017 (KR) ..... 10-2017-0088912

(51) Int. Cl.

| | |
|---|---|
| ***H01B 7/295*** | (2006.01) |
| ***H01B 9/02*** | (2006.01) |
| ***H01B 7/29*** | (2006.01) |
| *H01B 7/02* | (2006.01) |

(52) U.S. Cl.

CPC ..... *H01B 7/295* (2013.01); *H01B 7/292* (2013.01); *H01B 9/027* (2013.01); *H01B 7/02* (2013.01)

(58) Field of Classification Search

CPC ..... H01B 7/295; H01B 7/292; H01B 7/02; H01B 9/027

See application file for complete search history.

(56) References Cited

U.S. PATENT DOCUMENTS

| | | | | |
|---|---|---|---|---|
| 8,575,488 | B2 * | 11/2013 | Sugiyama | H01B 11/20 174/102 R |
| 2008/0124544 | A1 | 5/2008 | Alexander | |
| 2016/0329129 | A1 * | 11/2016 | Osborne, Jr. | H01B 7/295 |
| 2018/0358152 | A1 * | 12/2018 | Foss-Pedersen | H01B 3/082 |

FOREIGN PATENT DOCUMENTS

| | | | | |
|---|---|---|---|---|
| CN | 103559947 | | 2/2014 | |
| EP | 1172827 | A1 * | 1/2002 | H01B 3/441 |
| JP | 08007669 | A * | 1/1996 | |
| JP | H087669 | | 1/1996 | |
| JP | 2000011772 | | 1/2000 | |

OTHER PUBLICATIONS

KIPO Notification of Provisional Refusal dated May 17, 2018.
European Search Report dated Oct. 19, 2018.
KIPO Notification of Provisional Refusal dated Nov. 13, 2018.

* cited by examiner

*Primary Examiner* — Timothy J Thompson
*Assistant Examiner* — Amol H Patel
(74) *Attorney, Agent, or Firm* — Ipsilon USA, LLP

(57) ABSTRACT

A fire resistant cable comprising a conductor and a sheath surrounding the conductor, the cable is characterized in further comprising:

a bedding filler arranged between the conductor and the sheath and made of materials providing fire resistance; and, a tunnel filler arranged between the conductor and the sheath in the longitudinal direction of the cable, and having a melting point lower than the combustion point of the bedding filler.

14 Claims, 2 Drawing Sheets

FIRE RESISTANT CABLE

RELATED APPLICATION

This application claims the benefit of priority from Korean Patent Application No. 10-2017-0088912, filed on Jul. 13, 2017, the entirety of which is incorporated by reference.

TECHNICAL FIELD

The present invention relates to a fire resistance cable, and more particularly to a fire resistance cable that can maintain the function of electrical conduction for a certain period of time in case of a high-temperature fire such as a hydrocarbon fire (HCF).

BACKGROUND ART

Norwegian Electrotechnical Committee (NEK) publishes a technical specification they accept. NEK TS 606 defines the requirements for cables for offshore oil & gas, ships and ocean installations. The requirements include flame retardance, fire resistance, content of halogen, smoke emission, oil and mud resistance, jet fire (JF) resistance and hydrocarbon fire (HCF) resistance. Moreover, they require the tests according to IEC Standards or ISO Standards for the defined items respectively.

Most of all, the HCF resistance is essential for the cables for ocean plants dealing with massive fossil fuel because the scale of possible fires is enormous. In the prior art, the cable installed in a place where the risk of fire is high in industrial sites is provided with thick fire-proof sheathes. However, this solution is disadvantageous because it requires complicated installation procedures, expensive cost, and large volume, and thus the installation is not flexible for different places.

DISCLOSURE OF INVENTION

Technical Problem

Therefore, the present invention aims to solve the above problems and to provide a fire resistant cable, particularly a HCF cable that can maintain the function of electrical conduction for an extended period of time in case of a high-temperature fire such as a hydrocarbon fire.

Technical Solution

To this end, the fire resistant cable according to the present invention comprising a conductor and a sheath surrounding the conductor, the cable is characterized in further comprising:

- a bedding filler arranged between the conductor and the sheath and made of materials providing fire resistance; and,
- a tunnel filler arranged between the conductor and the sheath in the longitudinal direction of the cable, and having a melting point lower than the combustion point of the bedding filler.

The tunnel filler advantageously melts before the bedding filler's combustion so as to provide air tunnel in the cable. In other words, the tunnel filler is able to make air tunnel when it melts down before the bedding filler's combustion.

In a preferred embodiment the present invention, the tunnel filler is arranged on either side of the bedding filler or embedded in the bedding filler. An insulator may be provided around the conductor for electrical insulation, and the tunnel filler may be arranged between the insulator of the conductor and the sheath.

In the fire resistant cable according to the present invention, the tunnel filler functions as a normal sheath of the conductor, but it melts down before the bedding filler's combustion when the temperature is increased by a fire, and makes air tunnels to disperse heat and smoke penetrating the cable. This improves the fire resistance properties of the cable and extends the time period for the conductor to maintain its functions.

In addition, the air tunnels formed after melting of the tunnel filler at a high temperature provide space to receive the expansion of the bedding filler when it expands by high temperature, and thereby it is possible to prevent the expanded bedding filler from pressing the conductor inside and causing cracks in the outer side of the cable.

Preferably, the tunnel filler consists of a plurality of strings, arranged more particularly as a layer all around the conductor. The strings can be more preferably regularly arranged all around the conductor. The tunnel filler, or more particularly the plurality of strings, can be made from a polyolefin, and preferably by extrusion of said polyolefin. The polyolefin can be polypropylene and/or polyethylene. Polypropylene can be a polypropylene block copolymer, and more preferably a high crystallinity polypropylene block copolymer (HCPP). Polyethylene can be selected among low density polyethylene (LDPE) (with for example a density from 0.910 to 0.925 g/cm$^3$, according to ASTM D1505), medium density polyethylene (MDPE) (with for example a density from 0.926 to 0.940 g/cm$^3$, according to ASTM D1505), high density polyethylene (HDPE) (with for example a density from 0.941 to 0.965 g/cm$^3$, according to ASTM D1505), and a mixture thereof. The strings constituting the tunnel filler can preferably have a diameter from 2.0 to 10.0 mm, and more preferably from 5.0 to 10.0 mm.

In another embodiment of the present invention, the bedding filler is made of a composition comprising polymer resin with fire resistant additive. In this case, the polymer resin may be silicone resin, and the fire resistant additive may be at least one of silica, mica powder and glass powder. The bedding filler may be advantageously made of a ceramifiable compound which is changed to ceramic as the temperature increases and forms a fire resistant barrier.

The fire resistant cable of the present invention may include any elements of the conventional cables, for example a shield for electromagnetic shielding or a semiconductor for uniform spreading of an electric field may be applied around the conductor. Additionally, the cable may be configured as a multi-core cable comprising a plurality of conductors electrically isolated from each other, and the plurality of conductors may have a common insulator.

In the present invention, the tunnel filler may preferably be arranged all around the conductor.

In other words, the tunnel filler has a substantially constant thickness all around the conductor, to advantageously provide an optimized protection of the conductor.

The tunnel filler has more preferably a mechanical property from 12 N/mm$^2$ to 18 N/mm$^2$.

In a preferred embodiment of the present invention, the tunnel filler has a melting point which is below the combustion point (or burning temperature) of the bedding filler. More particularly, the tunnel filler has a melting point of at least 1.5 times, and more preferable of at least 2 times, smaller than the combustion point (or burning temperature) of the bedding filler. The combustion point of the bedding filler can be inferior to the melting point of the bedding filler. More particularly, when the bedding filler burns, it degrades and decomposes before it can reach its melting temperature. For example, the tunnel filler can have a melting point of 150° C., and the bedding filler can have a burning temperature of 300° C.

Hereinafter, further features and functions of the present invention are described in greater detail by exemplary embodiments with reference to the accompanying drawings, which are not intended to limit the scope of the present invention.

BEST MODE FOR CARRYING OUT THE INVENTION

Figure 1:
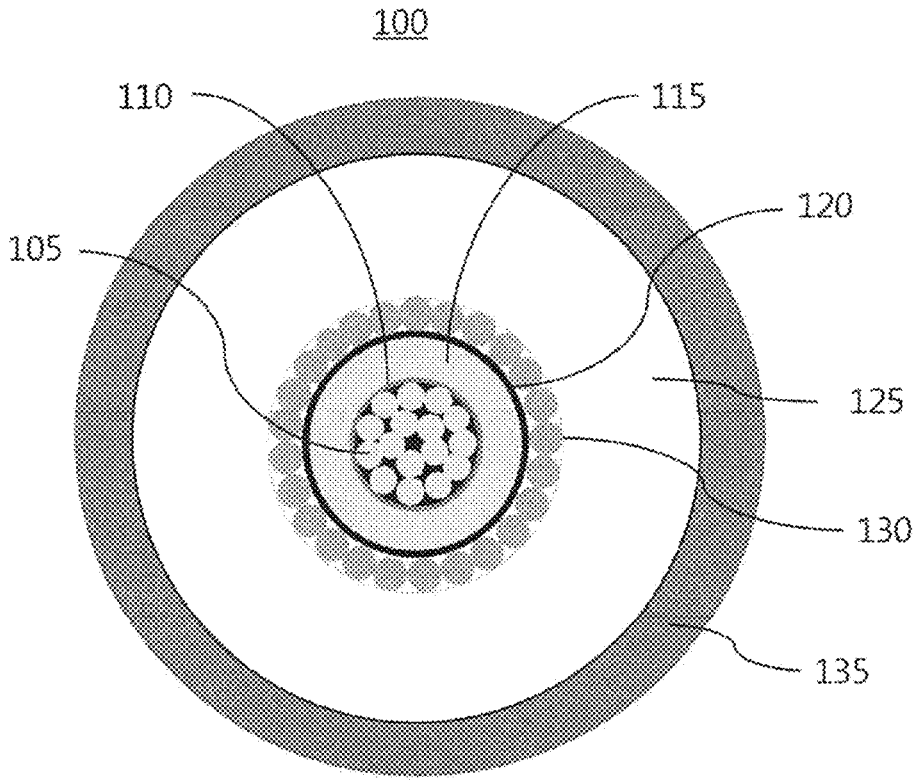
FIG. 1 illustrates a cross section of the fire resistant cable according to one embodiment of the present invention.

FIG. 1 shows a cross section of the fire resistant cable according to one embodiment of the present invention, the fire resistant cable 100 comprising a conductor 105, an insulator 110 around the conductor 105, a semi-conductive filler 115 and a shield 120 around the insulator 110, a bedding filler 125 around them which is solidified in case of a fire and providing fire resistance properties, and a tunnel filler 130 arranged on inner side of the bedding filler 125. A sheath 135 is arranged in the outmost layer.

The fire resistant cable 100 is an electric cable to transmit electric power applied on the conductor 105, and can be used in ocean installations or ships that operate offshore oil drilling.

In particular, the conductor 105 consists of electrically conducting wires, and configured to a stranded conductor of several twisted wires or a single conductor. The conductor 105 is made of conductive metal that is commonly copper.

The insulator 110 surrounding the conductor 105 is made of non-conductive materials and provides an electrical insulation for the conductor 105 against outside. The semi-conductive filler 115 surrounding the insulator 110 make an electrical field uniform. In other words, the semi-conductive filler 115 uniformly spreads the distribution of electric flux so that the dielectric breakdown is prevented. The semi-conductive filler 115 can be made by extruding a semi-conductive compound. The shield 120 surrounding the semi-conductive filler 115 is provided for shielding the intrusion of electromagnetic noise waves from outside, and configured as a copper braid made of a mesh of twisted several copper wires, or a spiral shield by copper wires, or an aluminum wrap shield by an aluminum tape. The above mentioned insulator 110, semi-conductive filler 115, or shield 120 can be omitted or included as multiple layers in any combination as necessary in the cable according to the present invention such as the conventional electric cables, or other elements commonly used for the conventional electric cables can be also provided.

The bedding filler 125 forms a fire resistant barrier as it becomes solidified in case of a fire. It can be made by extruding a polymer resin compound. Advantageously, the polymer resin is silicone resin, and fire resistant additive such as silica, mica powder, and/or glass powder can be added.

The bedding filler may have a combustion point of at least 300° C., and more preferably of at least 350° C. The combustion point of the bedding filler can be easily determined by a method well known in the art, such as by cone calorimeter.

In one embodiment of the present invention, the bedding filler 125 may be formed by extruding halogen free fire resistant compound. Advantageously, the bedding filler 125 can be made of a ceramifiable compound which is changed to ceramic as the temperature increases and provides a fire resistant barrier. The ceramifiable compound can include silicone elastomer (or silicone rubber) as well as calcium carbonate ($CaCO_3$). The silicone-$CaCO_3$ mixture can form Wollastonite ($CaSiO_3$), Calcium Oxide (CaO), Larnite ($Ca_2SiO_4$), Calcite ($CaCO_3$), Calcium Silicate ($Ca_2SiO_4$), Portlandite ($Ca(OH)_2$), $SiO_2$ (Hexagonal), or $SiO_2$ (Rhombohedral) during its combustion in high temperature. These products remain as residues even at a high temperature above 1000° C. and provide good insulation and fire resistance properties.

The tunnel filler 130 arranged inside of the bedding filler 125 is made of a material which melts at a temperature below the combustion point of the bedding filler 125. Advantageously, the tunnel filler 130 can be configured as a plurality of strings extended in the longitudinal direction of the cable, which are preferably made by extrusion of polypropylene or polyethylene. The tunnel filler 130 can have any numbers, shapes, or arrangements optionally selected as required, and is not limited to any specific examples.

The tunnel filler may have a melting point of at most 150° C., and more preferably of at most 120° C. The melting point of the tunnel filler can be easily determined by a method well known in the art, such as by DSC (Differential Scanning calorimeter).

As stated above, the tunnel filler 130 melts at a temperature lower than the temperature at which the bedding filler 125 combust. In other words, the melting point of the tunnel filler 130 is lower than the combustion point of the bedding filler 125. Thus, as the temperature of the cable 100 is increasing in case of a fire, the tunnel filler 130 reaches the melting point and melts before the bedding filler 125 combusts, and thereby forms communicated tunnels in the longitudinal direction of the cable in the spaces which the tunnel filler 130 have occupied. The longitudinal tunnels after melting of the tunnel filler 130, i.e. air tunnels provide passages to disperse heat and smoke penetrating the cable locally and thereby improves the fire resistance properties of the cable.

Moreover, the bedding filler 125 tends to expand when it is solidified or changed to ceramic as the temperature increases in case of a fire and the expanded bedding filler 125 can press the conductor inside or cause cracks in the outer side of the cable. However, in the cable according to the present invention, the air tunnels formed after melting of the tunnel filler 130 at a high temperature provide space to receive the expansion of the bedding filler 125 and thus can remove the pressure applied on the conductor and prevent cracks of the cable.

Although the air tunnels can improve the fire resistance properties of the cable in case of a fire, if they are produced when the cable is manufactured, the cable will have an inherent risk of intrusion of hazardous gas or materials and migration of the gas or materials through the air tunnels in normal use in hazardous areas. However, in the fire resistant cable according to the present invention, the tunnel filler 130 does not allow any migration of hazardous gas or materials in normal use since it fills the cable and functions as a sheath in normal use, and only produces air tunnels by melting in a high temperature in case of a fire.

The sheath 135 surrounding the bedding filler 125 is arranged in the outmost layer to protect the cable from impact or contamination of outside and to insulate the cable. The sheath 135 can be made of cross-linked polyolefin (XLPO), halogen free polyolefin (HFPO), or the like.

Figure 2:
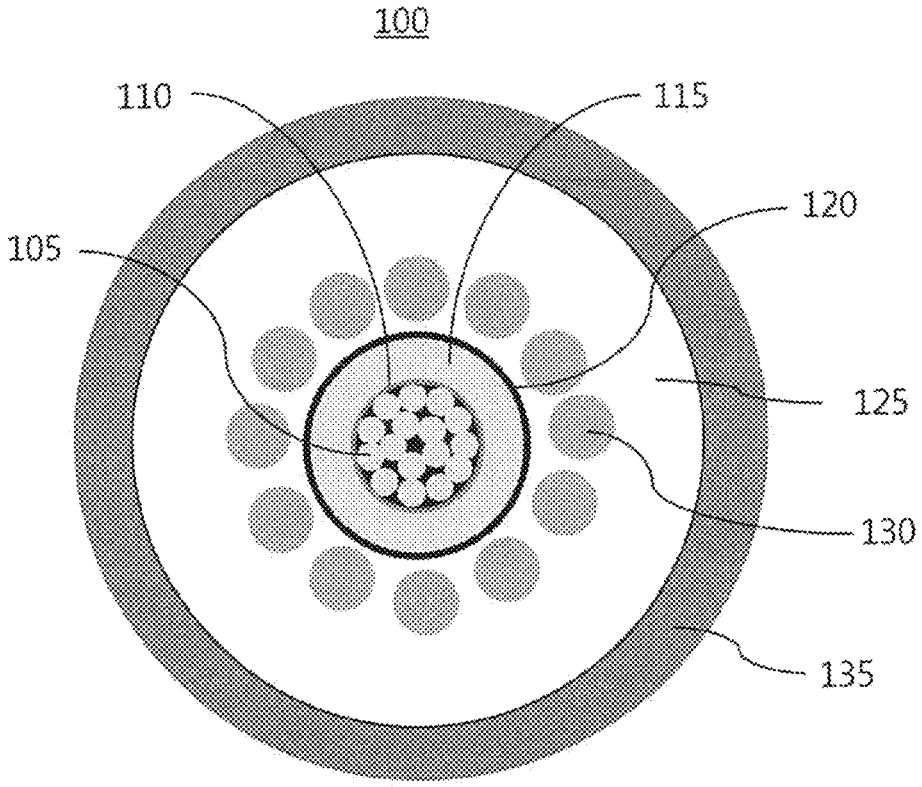
FIG. 2 illustrates a cross section of the fire resistant cable according to another embodiment of the present invention.

FIG. 2 shows a variant embodiment of the present invention, which is the same as that of FIG. 1 except that the tunnel filler 130 is embedded in the bedding filler 125. Identical reference numerals are used for identical components in the embodiment FIG. 2. In the embodiment of FIG. 2, the tunnel filler 130 melts in case of a fire and makes air tunnels for dispersing heat and smoke in the same manner.

The configurations of the cable 100 illustrated in the figures are to present examples of the present invention and not to limit the present invention in any way. If the bedding filler 125 and the tunnel filler 130 are arranged between the conductor 105 and the sheath 135, the other components such as the insulator 110, the semi-conductive filler 115 and the shield 120 can be omitted or included as multiple layers in any combination as necessary in the cable, or other elements commonly used for the conventional electric cables can be also provided.

In addition, although the cable 100 illustrated in the figures is a single-core cable with one conductor 105, the cable may be configured as a multi-core cable comprising a plurality of conductors electrically isolated from each other, wherein each of the conductors may have an insulator, a semi-conductive filler, or a shield respectively.

The table 1 below shows the result of tests for the duration of the maintenance of the function of cables without electric breakdown or short circuit in case of a hydrocarbon fire (HCF). Cables 2 to 4 use silicon elastomer for a bedding filler, the silicon elastomer being for example the reference HR-7027U commercialized by HRS. Cable 3 uses polypropylene (PP) for a tunnel filler, the polypropylene being for example the reference YUHWA POLYPRO CB2203 commercialized by Korea Petrochemical Ind. Cable 4 uses polyethylene (PE) for a tunnel filler, the polyethylene being for example the reference CHNA-8380L commercialized by the Hanwha Chemical. The tunnel filler of Cable 3 and 4 are a plurality of strings forming a layer all around the cable's conductor, each string having a diameter around 8 mm. A conventional cable (Cable 1) is also tested for comparison.

TABLE 1

| | Cable 1 (conventional cable) | Cable 2 (bedding filler) | Cable 3 (bedding filler + PP tunnel filler) | Cable 4 (bedding filler + PE tunnel filler) |
|---|---|---|---|---|
| Time (mm:sec) | 18 | 22:06 | 28:45 | 37:55 |

As shown in the table 1, the cables according to the present invention increase the duration of the maintenance of the function of cable in case of a HCF by 58% when PP tunnel filler is used (Cable 3) and even by 110% when PE tunnel filler is used (Cable 4), compared to the conventional cable (Cable 1).

The above test result clearly demonstrates that not only the bedding filler forms a fire resistant barrier as it is changed to ceramic when its temperature increases, but also the tunnel filler significantly improves the fire resistant properties by providing air tunnels for dispersing heat and smoke after melting as its temperature increases.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

REFERENCES

100 Cable
105 Conductor
110 Insulator
115 Semi-conductive filler
120 Shield
125 Bedding filler
130 Tunnel filler

The invention claimed is:

1. A fire resistant cable comprising:
a conductor and a sheath surrounding the conductor;
a bedding filler arranged between the conductor and the sheath and made of materials providing fire resistance; and
a tunnel filler arranged between the conductor and the sheath in the longitudinal direction of the cable, and having a melting point lower than the combustion point of the bedding filler, wherein the tunnel filler is made of a plurality of strings,
wherein the tunnel filler has a melting point of at least 1.5 times smaller than the combustion point of the bedding filler.

2. The fire resistant cable according to claim 1, wherein the tunnel filler is arranged on either side of the bedding filler or embedded in the bedding filler.

3. The fire resistant cable according to claim 1, wherein an insulator is provided around the conductor for electrical insulation.

4. The fire resistant cable according to claim 3, wherein the tunnel filler is arranged between the insulator of the conductor and the sheath.

5. The fire resistant cable according to claim 3, wherein the insulator is surrounded by a semi-conductive filler and by a shield.

6. The fire resistant cable according to claim 5, wherein the tunnel filler is arranged between the shield of the conductor and the sheath.

7. The fire resistant cable according to claim 1, wherein the tunnel filler is made by extrusion of polypropylene or polyethylene.

8. The fire resistant cable according claim 1, wherein the bedding filler is made of a composition comprising polymer resin and fire resistant additive.

9. The fire resistant cable according to claim 8, wherein the polymer resin is silicone resin.

10. The cable fire resistant cable according to claim 8, wherein the fire resistant additive is at least one of silica, mica powder and glass powder.

11. The fire resistant cable according to claim 1, wherein the bedding filler is made of ceramifiable compound which is changed to ceramic as the temperature increases and becomes a fire resistant barrier.

12. The fire resistant cable according to claim 1, wherein the conductor is configured to a plurality of conductors that are electrically isolated from each other, and the plurality of conductors has a common insulator.

13. The fire resistant cable according to claim 1, wherein the tunnel filler melts before the bedding filler's combustion so as to provide air tunnel in the cable.

14. The fire resistant cable according to claim 1, wherein the tunnel filler is arranged all around the conductor.

* * * * *